US005849101A

United States Patent [19]

Edwards et al.

[11] Patent Number: 5,849,101

[45] Date of Patent: Dec. 15, 1998

[54] DISHWASHER CYCLE—INITIAL CYCLES LOWER SPRAY ARM ONLY

[75] Inventors: James M. Edwards, Kinston; John E. Dries, Goldsboro, both of N.C.

[73] Assignee: White Consolidated Industries, Inc., Cleveland, Ohio

[21] Appl. No.: 692,438

[22] Filed: Aug. 5, 1996

[51] Int. Cl.[6] ..... B08B 9/20; B08B 7/04; B08B 3/00

[52] U.S. Cl. ..... 134/18; 134/25.2; 134/95.3; 134/113; 134/172; 134/178; 134/10

[58] Field of Search ..... 134/25.2, 58 D, 134/10, 172, 178, 95.3, 57 D, 113–114, 18, 103.2

[56] References Cited

U.S. PATENT DOCUMENTS

| | | | |
|---|---|---|---|
| 3,440,399 | 4/1969 | Reifenberg . | |
| 3,648,931 | 3/1972 | Jacobs | 134/58 D |
| 4,094,702 | 6/1978 | Rabuffetti | 134/10 |
| 4,135,531 | 1/1979 | Federighi et al. | 134/95.3 |
| 4,159,211 | 6/1979 | Hoffman et al. | 134/57 D |
| 4,741,353 | 5/1988 | Milocco | 137/119.03 |
| 5,264,043 | 11/1993 | Milocco | 134/25.2 |
| 5,435,885 | 7/1995 | Jones et al. | 134/34 |
| 5,494,062 | 2/1996 | Springer | 134/58 D |
| 5,525,161 | 6/1996 | Milocco et al. | 134/18 |

*Primary Examiner*—Ponnathapura Achutamurthy
*Assistant Examiner*—P. Ponnaluri
*Attorney, Agent, or Firm*—Pearne, Gordon, McCoy & Granger LLP

[57] ABSTRACT

A method of washing objects in a dishwasher having upper and lower spray arms within a wash chamber and a sump filter. Wash liquid entering a sump from the wash chamber to be recirculated by a pump is filtered the filter to prevent soils from entering the sump and being recirculated. When the lower spray arm is operating, wash liquid is directly sprayed onto the filter from a clean-out nozzle on the lower spray arm to clean soils off the filter and prevent the filter from clogging. During a pre-wash cycle and at least one pre-rinse cycle, wash liquid is continuously sprayed from only the lower spray arm to prevent the filter from clogging when heavy soils are removed. During a wash cycle and at least one rinse cycle, wash liquid is alternately sprayed from the lower spray arm and the upper spray arm when the heavy soils have already been removed and it is less likely the filter will become clogged.

18 Claims, 4 Drawing Sheets

DISHWASHER CYCLE— INITIAL CYCLES LOWER SPRAY ARM ONLY

BACKGROUND OF THE INVENTION

1. Field of the Invention

This invention relates generally to the field of dishwashers and specifically to a method of alternating liquid flow between upper and lower spray arms.

2. Description of the Art

Washing machines, particularly dishwashers, often have two or more spray arms for directing washing liquid at objects to be washed. Typically, a lower spray arm is located near the bottom of a wash tub and an upper spray arm is located in a middle area or near the top of the wash tub. A pump is provided to deliver liquid from a sump in the bottom of the tub to the spray arms. Commonly, the liquid is delivered simultaneously to both spray arms in more or less equal amounts.

U.S. Pat. Nos. 4,741,353 and 5,264,043, both to Milocco and incorporated herein in their entirety by reference, show and describe an apparatus and method for alternating liquid flow between the spray arms. A specialized ball valve switches flow from one arm to the other when operation of the pump is interrupted for a certain amount of time. The Milocco references show a programmed electronic controller for operating the pump to achieve proper operation of the valve.

U.S. Pat. No. 5,494,062, commonly assigned and incorporated herein in its entirety by reference, is directed to an electromechanical controller for operating a pump to achieve proper operation of a valve which alternates flow between the upper and lower spray arms during washing. The valve is controlled by periodic interruption of the pump for certain lengths of time. An electromechanical timer has a main cam wheel which controls the pump, along with other parts of the dishwasher, and an auxiliary cam wheel which at times overrides the main cam wheel.

It has been found that a dishwasher which alternates flow between upper and lower spray arms may cause a sump filter to clog with soils if flow is switched to the upper spray arm prior to removal of an initial mass of soils from the filter. The filter does not clog while the lower spray arm is operating because the lower spray arm typically has "clean-off" jets or nozzles which clear soil off the top of the filter. Accordingly it is desirable to provide a method of operating a dishwasher which both prevents the sump filter from clogging with soils and alternates the flow of the liquid to the spray arms to maximize the cleanliness of the dishes.

SUMMARY OF THE INVENTION

The present invention provides a method for operating a washer with two sprayers for spraying wash liquid which overcomes the above-noted problem of the related art. The method includes continuously spraying wash liquid from the lower spray arm during initial cycles and alternately spraying wash liquid from the lower spray arm and the upper spray arm during main cycles. Continuously spraying wash liquid from the lower wash arm during the early stages of dishwasher operation enables the lower wash arm to keep the sump filter clean during the period of heavy soiling at the beginning of the cleaning operation. Once the period of heavy soiling is over and the risk of clogging the filter is minimal, the flow is alternated between the sprayers to maximize the cleanliness of the objects to be cleaned.

Preferably the washer has upper and lower spray arms for spraying wash liquid and a pump for delivering fluid to the spray arms. A valve controls flow from the pump to the spray arms to alternate fluid flow between the spray arms. A controller is adapted for stopping and starting the pump and thereby controlling the valve to alternate flow of fluid to the spray arms. The valve preferably includes a ball adapted to block one of two conduits in communication with respective spray arms. The valve is adapted to move the ball from one conduit to the other when flow to the valve is interrupted.

The controller is preferably an electromechanical controller including a first switch connected to energize the pump, a first timer wheel adapted to operate the first switch so as to energize the pump for a certain period of time, and a second timer wheel adapted to override the first timer wheel to operate the first switch so as to deenergize the pump for a certain period of time. A second switch is connected in parallel with the first switch and is adapted to operate the pump regardless of the state of the first switch.

DESCRIPTION OF THE PREFERRED EMBODIMENTS

Figure 1:
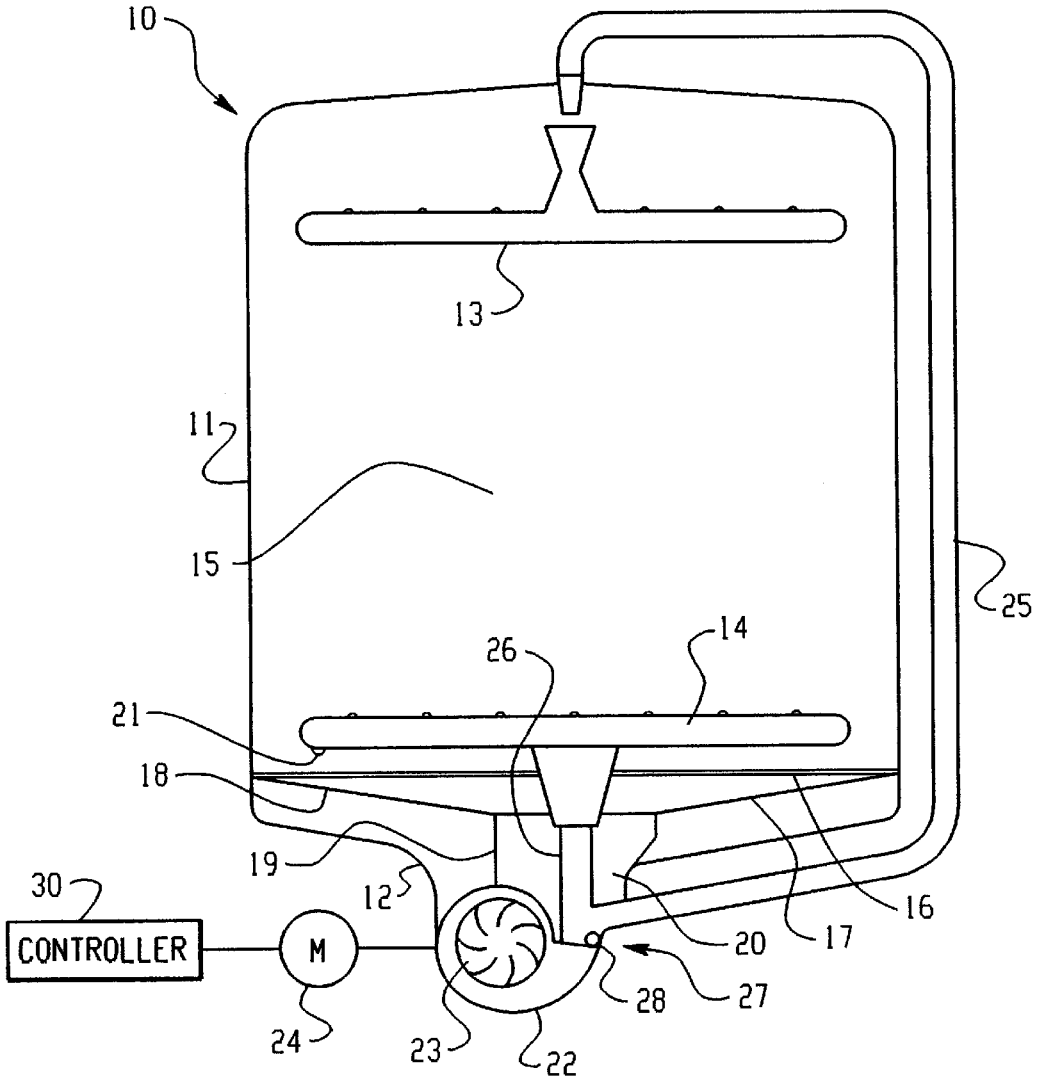
FIG. 1 is a schematic front elevational view of a dishwasher according to the invention.

Referring to FIG. 1, a dishwasher 10 includes a molded plastic tub 11 having a sump 12 molded therein. The sump 12 collects and holds wash liquid that is sprayed from upper and lower spray arms 13, 14 onto objects to be washed held within a wash chamber 15 defined by the tub 11. A coarse filter 16 such as, for example, a grate is disposed between the wash chamber 15 and the sump 12 to prevent flatware and other large objects from entering the sump 12. A fine filter 17, having a generally horizontal filter component 18 and an annular vertical filter component 19 is disposed in the sump 12 below the coarse filter 16. The fine filter 17 is preferably a molded mesh screen having 4 mm (0.015 in.) openings.

Wash liquid flows downwardly from the wash chamber 15 through the horizontal filter component 18 and into the sump 12. The fine filter 17 removes food particles and/or other material in the wash liquid before the wash liquid enters the sump 12. The horizontal filter component 18 is sloped downwardly toward a collection chamber 20 to "funnel" food particles removed from the wash liquid from the wash chamber 15 to the collection chamber 20.

The horizontal filter component 18 is located directly below the lower wash arm 14. The lower wash arm 14 is provided with at least one "clean-out" spray jet or nozzle 21 adapted to direct wash liquid directly at the horizontal filter component 18 and propel filtered food particles toward the collection chamber 20. The food particles are held in the collection chamber 20 and are preferably chopped, minced, or macerated therein before being evacuated to a drain.

The sump 12 is in communication with an inlet of a pump 22 having an impeller 23 driven by a motor 24. The pump 22 is adapted for delivering liquid to the upper and lower spray arms 13, 14 through suitable conduits 25, 26. A valve 27 is disposed between an outlet of the pump 22 and the conduits 25, 26. The valve 27 includes a ball 28 for alternately blocking each of the conduits 25, 26 to limit liquid flow to only one of the spray arms 13, 14 at a time. Such a valve 27 is described in detail in U.S. Pat. No. 4,741,353 to Milocco.

Interruption of liquid flow from the pump 22 through the valve 27 causes the ball 28 to change positions from blocking one of the conduits 25, 26 to blocking the other of the conduits 25, 26 so that, when flow resumes, liquid is delivered to the other one of the spray arms 13, 14. Thus, as described below, proper control of liquid flow from the pump 22 causes alternating flow to the spray arms 13, 14. A controller 30 is connected to the pump motor 24 to achieve the desired liquid flow.

Figure 2:
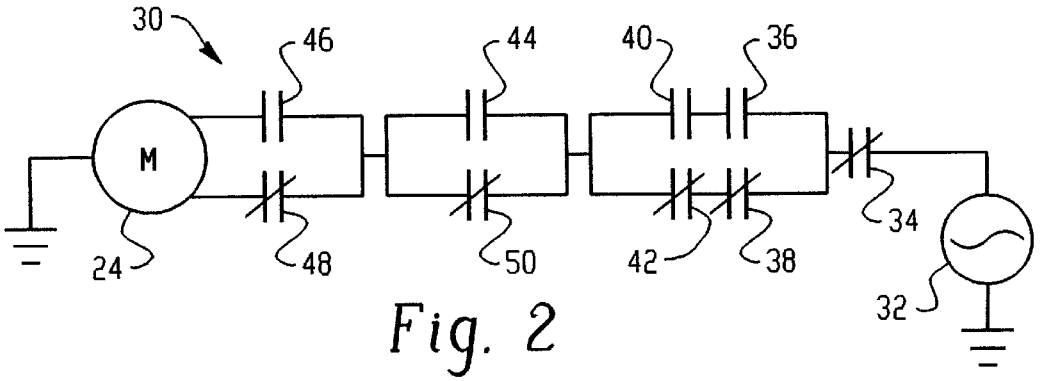
FIG. 2 is a schematic diagram of an electrical circuit of the dishwasher of FIG. 1.

Referring to FIG. 2, the controller 30 is connected between the pump motor 24 and a power source 32 such as a household alternating current supply. The controller 30 includes a door switch 34 that is normally closed when a door closing the tub 11 is closed and locked. A rinse cycle selector switch 36 and a wash cycle selector switch 38 are connected in parallel with each other and in series with the door switch 34. The rinse cycle selector switch 36 is closed for a "rinse & hold" and a "pots & pans" dishwasher cycle or washing operation. The wash cycle selector switch 38 is closed for a "normal wash" and the "pots & pans" washing operation.

A first bus switch 40 and a second bus switch 42 are connected in series with the respective cycle selector switches 36, 38. The bus switches 40, 42 are normally open. The first bus switch 40 is closed during a pre-rinse cycle and the second bus switch 42 is closed during the remaining period of operation. Other combinations of cycle switches and bus switches for controlling other cycles are also suitable and well known in the art.

A motor switch 44 is connected in series with the bus switches 40, 42. The motor switch 44 is normally closed and is opened to deenergize the pump motor 24 and also during interrupted operation of the pump motor 24 to achieve alternating flow of liquid to the spray arms 13, 14, as discussed below. A drain switch 46 is connected in series with the motor switch 44. The drain switch 46 is normally closed and operates the pump motor 24 during a drain phase. The drain switch 46 is opened during phases other than draining. A wash switch 48 is connected in series with the motor switch 44 and in parallel with the drain switch 46. The wash switch 48 is normally closed and operates the pump motor 18 during washing and rinsing operations. Unless stated otherwise, it is assumed that the wash cycle switch 38, second bus switch 42, and wash switch 48 are closed during operations discussed below.

A motor interval switch 50, is connected in parallel with the motor switch 44. The motor interval switch 50 is normally closed, but is held open during all operations except during interrupted operation of the pump motor 24. The following description relates primarily to the operation of the motor interval switch 50 and corresponding operation of the pump 2 during a cycle in which flow alternates between the spray arms 13, 14. The combinations and connections of other switches can vary.

Figure 3:
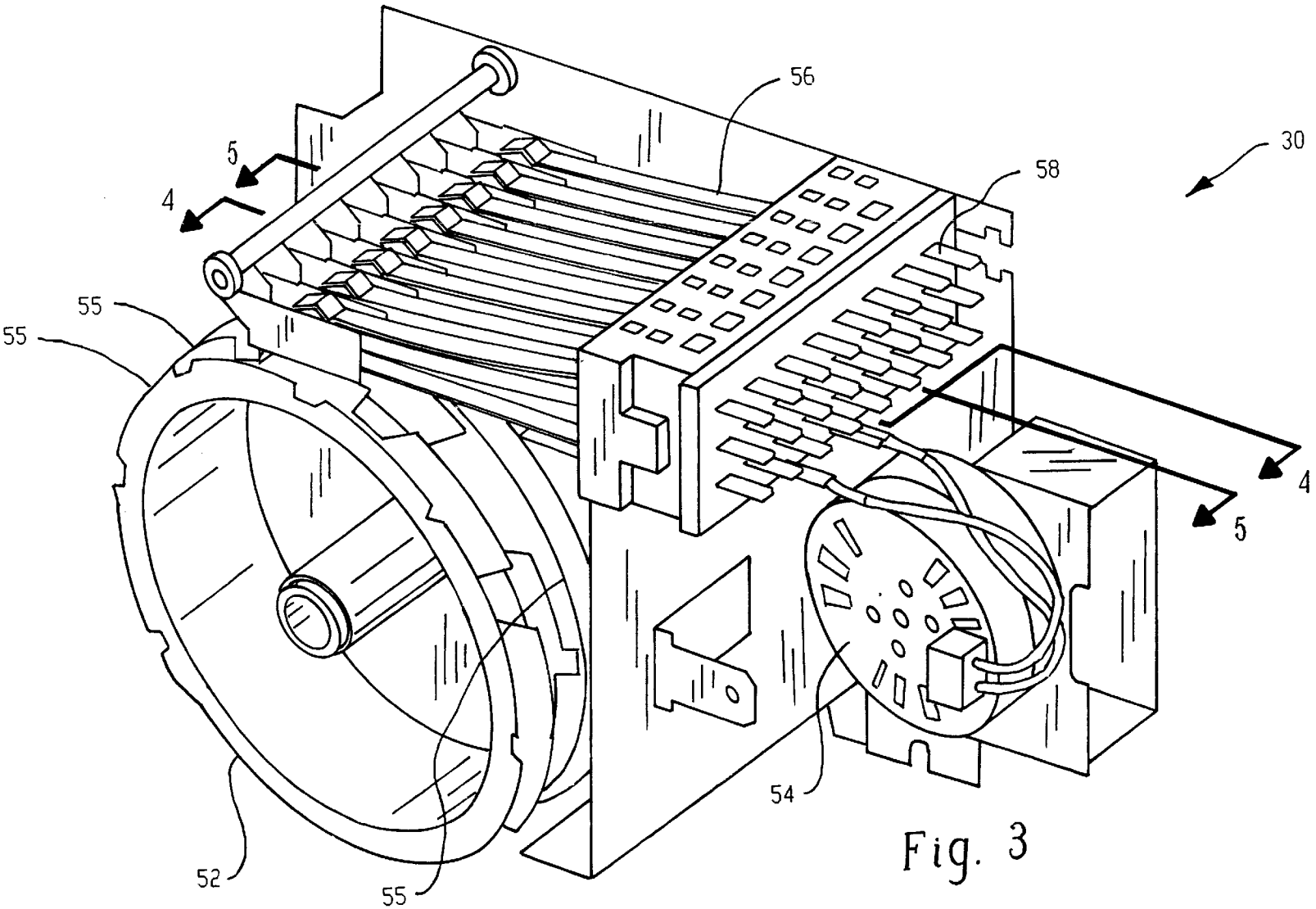
FIG. 3 is a perspective view of a controller of the dishwasher of FIG. 1.

Referring to FIG. 3, the controller 30 includes a cam wheel 52 driven by a timer motor 54. The cam wheel defines a plurality of coaxial cam disks 55. Plural spring arms 56 are located above the cam wheel 52 and electrically connected to connection lugs 58. The lugs are adapted to be connected to electrical circuits of the dishwasher 10.

Figure 4:
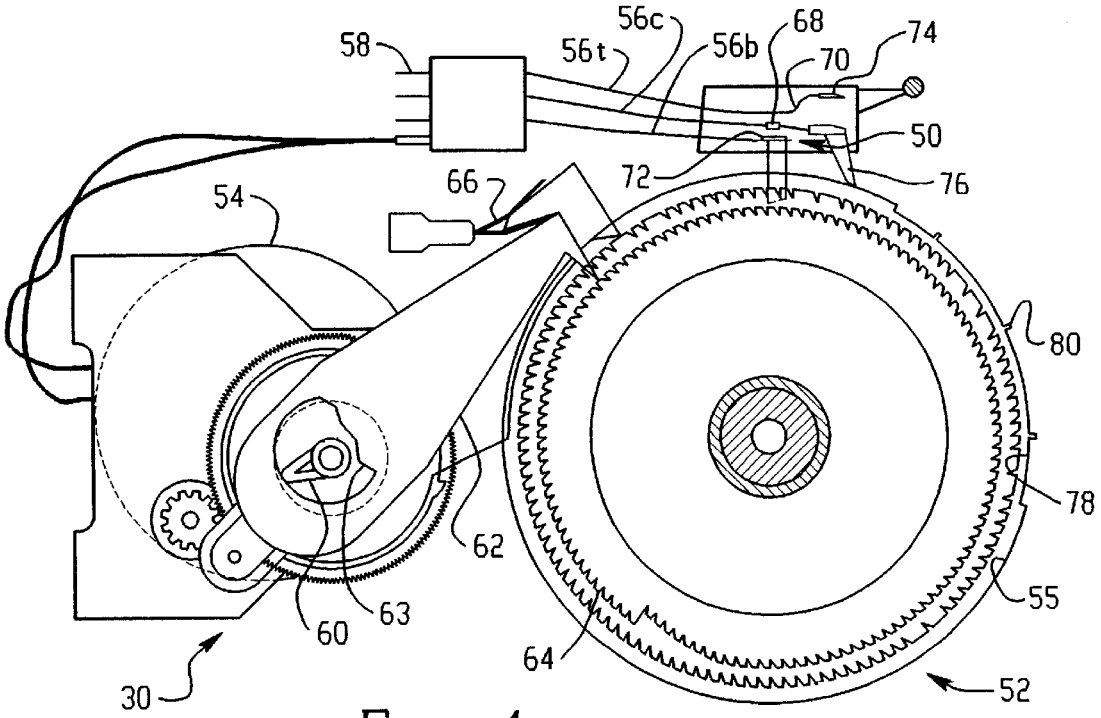
FIG. 4 is a front elevational view, in cross-section, of the controller of FIG. 3 taken along line 4—4 of FIG. 3.

Referring to FIG. 4, the timer motor 54 rotates an eccentric cam 60 on an axis to oscillate a finger 62 having an eccentric opening 63. The finger 62 engages teeth 64 on the cam wheel 52 to drive the cam wheel stepwise about an axis of the cam wheel 52. The finger 62 is biased toward the teeth 64 by a spring 66.

The spring arms 56 are arranged in sets of three, each set including a top arm 56*t*, a center arm 56*c*, and a bottom arm 56*b*. The center arm 56*c* is provided with a pair of electrical contacts 68 adapted to create an electrically conducting path with a contact 70 on the top arm 56*t* or a contact 72 on the bottom arm 56*b*. The bottom arm 56*b* is biased to normally close its contact 72 with the bottom contact 68 of the center arm 56*c*.

In a conventional manner, contacts 68, 70, 72 on different sets of spring arms 56 are used as the switches 40, 42, 44, 46, 48 discussed above. Preferably contacts 68, 72 on the bottom arm 56*b* and center arm 56*c* nearest the front of the controller 30 are used as the motor interval switch 50, for reasons discussed below. A contact spacer 74 positions the top and bottom arms 56*t*, 56*b* to maintain a proper air gap between the contacts 68, 70, 72. A cam follower 76 is provided at an end of the center arm 56*c*. The cam disk 55 nearest the front of the controller 30 corresponds with the spring arms 56 nearest the front.

The cam disk 55 engages the cam follower 76 to maintain the center arm 56*c* in a neutral position wherein the contacts 68, 70, 72 are open, as shown in FIG. 4. A tooth (not shown) on the cam disk 55 raises the center arm 56*c* to close the center contact 68 with the top contact 70. This is not utilized in the embodiment shown for the spring arms 56 nearest the front.

A gap 78 in the cam disk 55 permits the center arm 56*c* to lower and close with the bottom contact 72, thereby closing the wash interval switch 50. The front cam disk 55 is arranged with plural gaps 78. The gaps 78 are separated by lobes 80 that raise the center arm 56*c* and open the wash interval switch 50 to deenergize the pump motor 18. As the cam wheel 52 rotates, gaps 78 and lobes 80 on the cam disk 55 open and close the contacts 68, 72 to control operation of the pump motor 24 and pump 122. Similarly, other dishwasher functions are controlled by other contacts operated by gaps, lobes, and teeth of other cam disks.

Figure 6:
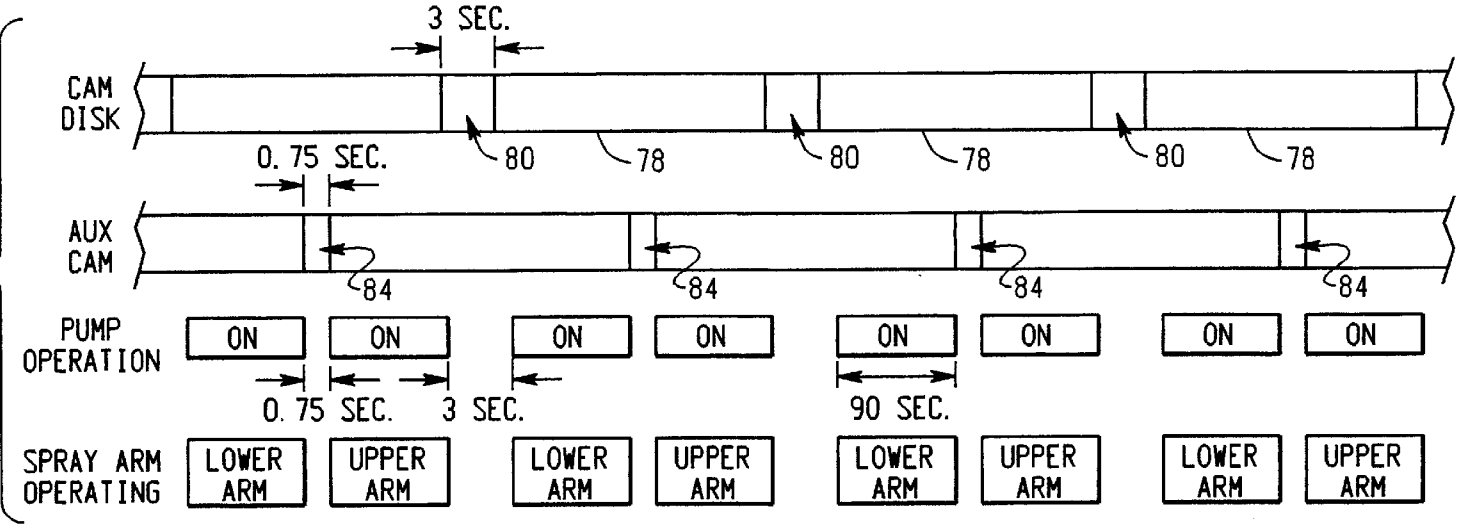
FIG. 6 is a timing diagram for operation of selected switches and a pump of the dishwasher.

Referring to FIG. 6, a first timing diagram shows the spacing of gaps 78 and lobes 80 and the corresponding operation of the pump 22. According to a preferred construction of the invention, the lobes 80 are spaced at approximately 180 second intervals and open the wash interval switch 50 (FIG. 2) for 3±1 seconds. It has been found that the period the wash interval switch 50 is held open by the lobes 80, is the minimum pause required to switch the valve 27 from providing flow to the upper spray arm 13 to providing flow to the lower spray arm 14. It is desirable to minimize the pause so that wash liquid is sprayed for a maximum period of time from the spray arms 13, 14 to obtain the best cleaning results.

Figure 5:
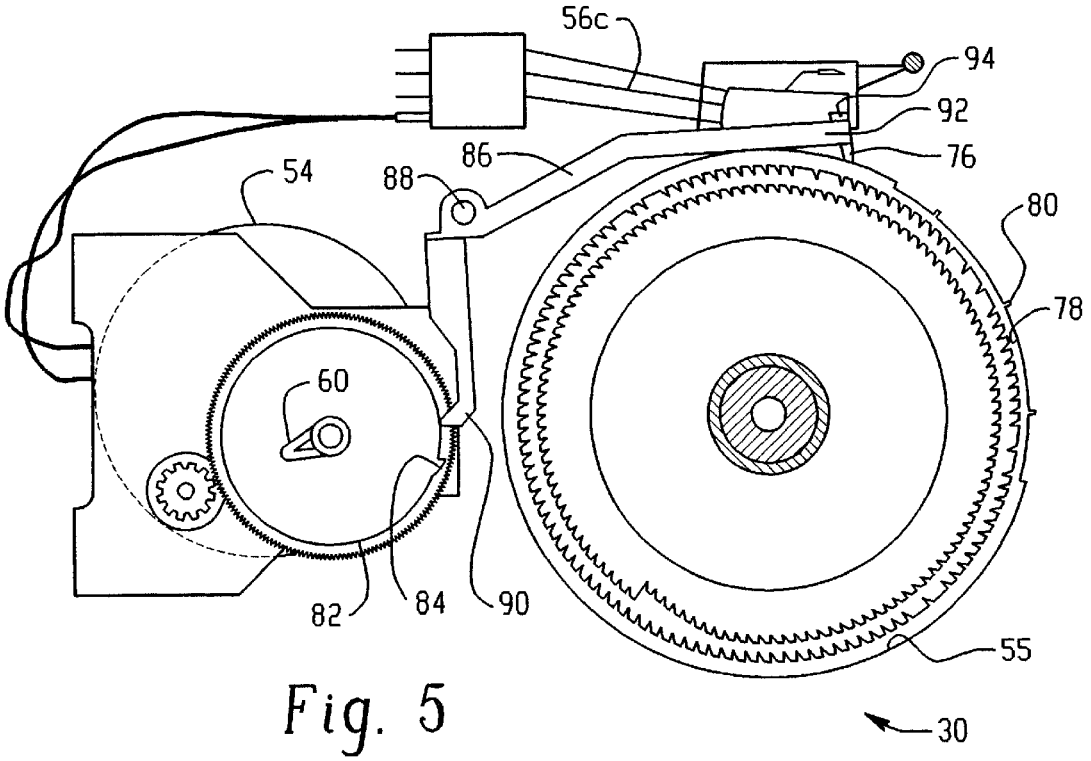
FIG. 5 is a front elevational view, in cross-section, of the controller of FIG. 3 taken along line 5—5 of FIG. 3.

Referring to FIG. 5, the timer motor 54 drives an auxiliary cam wheel 82 that is preferably concentric with the eccentric cam 60. The auxiliary cam wheel 82 has a generally smooth surface with a single lobe 84. The auxiliary cam wheel 82 is sized to rotate once in approximately 180 seconds, corresponding with the period of the gaps 78 on the cam disk 55. A lever 86 mounted on a pivot 88 has a cam follower 90 that engages the auxiliary cam wheel 82. An end 92 of the lever 86 opposite the cam follower 90 is positioned to operate an appendage 94 extending from the cam follower 76 of the center arm 56*c*. When the tooth 84 operates the lever 86, the center arm 56*c* is lifted to open the switch 50 (FIG. 2). The auxiliary cam wheel 82, thus, overrides the cam disk 55 to deenergize the pump motor 24 regardless of the cam disk 55 position. Referring again to FIG. 6, the lobe 84 opens the wash interval switch 50 (FIG. 2) for 0.75±0.25 seconds about every 180 seconds. The lobe 84 is positioned to open the wash interval switch 50 about midway between the lobes 80 on the cam disk 55. It has been found that the period the wash interval switch 50 is held open by the lobe 84, is the minimum pause required to switch the valve 27 from providing flow to the lower spray arm 14 to providing flow to the upper spray arm 13. As noted above, it is desirable to minimize the pause so that wash liquid is sprayed for a maximum period of time from the spray arms 13, 14 to obtain the best cleaning results.

During a period of about 180 seconds of operation, the pump 22 stops twice, once for about 0.75 seconds and once for about 3 seconds so that there are two blocks of "ontime" of about 90 seconds each for the pump 22. Each stop permits the ball 28 of the valve 26 to change positions so that, when the pump starts again, liquid flows to the opposite one of the spray arms 13, 14, thereby alternating the flow of wash liquid to the spray arms 13, 14. Each operation of the pump, in which flow alternates between the spray arms 13, 14, preferably begins with flow to the lower spray arm 14.

According to another embodiment of the invention (not shown), the auxiliary cam wheel can operate another switch separate from the motor interval switch 50. The other switch would be connected in series with the motor interval switch 50. Thus, the motor interval switch would not need to be nearest the front of the controller.

Figure 7:
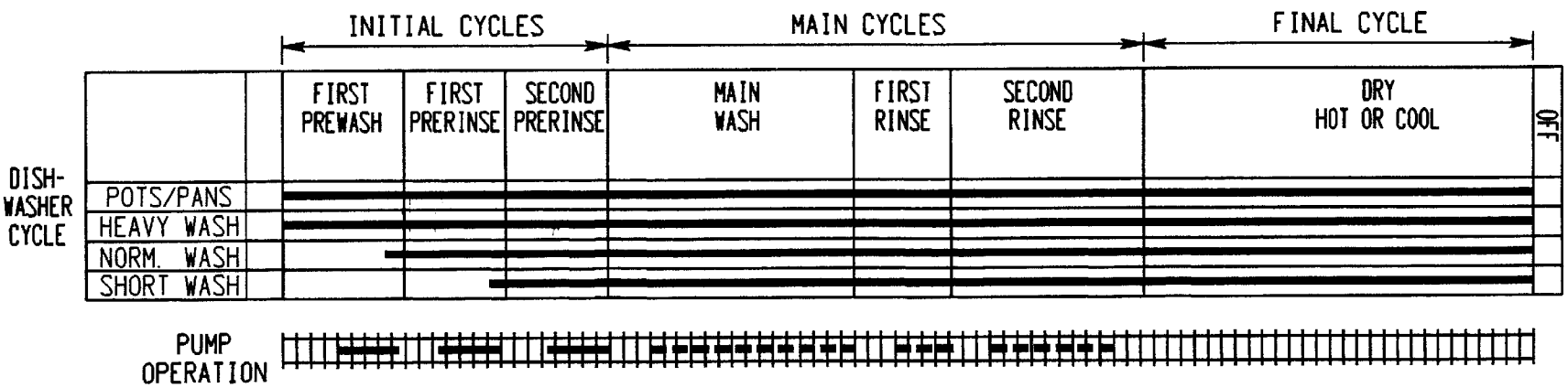
FIG. 7 shows a timing diagram for operation of the pump over various cycles of the dishwasher.

Referring to FIG. 7, a second timing diagram shows that the pump 22 is preferably operated continuously during initial cycles, such as a pre-wash cycle, a first pre-rinse cycle, and/or a second pre-rinse cycle, and operated with pauses as discussed above during main cycles, such as a main wash cycle, a first rinse cycle, and/or a second rinse cycle. The wash switch 44 is closed to operate the pump 22 continuously during the initial cycles so that wash liquid is sprayed continuously from the lower spray arm 14. Spraying wash liquid continuously from the lower spray arm 14 during the initial stages enables the clean off spray nozzle 21 (FIG. 1) to keep the fine filter 17 from clogging with food particles when the main mass of the food particles are cleaned-off the objects. The wash switch 44 is open and the wash interval switch 50 is operated as discussed above to intermittently operate the pump 22 during the main cycles so that wash liquid is alternately sprayed from the lower and upper spray arms 13, 14 when the fine filter 17 is less likely to become clogged because less food particles are cleaned-off the objects.

During a preferred "pots & pans" dishwasher cycle, the wash switch 44 is closed so that the pump 22 operates continuously during "on-times" in each of the pre-wash, first pre-rinse, and second pre-rinse cycles so that wash liquid is sprayed continuously from the lower spray arm 14. Wash liquid strikes the objects in the wash chamber 15 breaking loose food particles and flows down through the coarse filter 16, through the fine filter 17, and into the sump 12. Objects and large food particles are filtered from the wash liquid by the coarse filter 16. The large food particles are eventually eroded and dissolved until they pass through the coarse filter 16. Most of the remaining food particles are filtered out of the wash liquid by the fine filter 17. The filtered wash liquid flows into the sump 12 where it is recirculated to the wash arm 14 by the pump 22. Food particles on the fine filter 17 tend to move down the sloping horizontal filter component 18 and the vertical filter component 19 to the collection chamber 20. Wash liquid sprays onto the fine filter 17 from the clean off spray nozzle 21 to ensure that the food particles do not collect and clog the fine filter 17.

The wash switch 44 is open and the wash interval switch 50 controlled so that the pump 22 operates intermittently during "on-times" in each of the main wash, first rinse, and second rinse cycles so that wash liquid is alternately sprayed from the lower and upper spray arms 13, 14. Wash liquid first flows through the valve 27 and the conduit 26 to the lower spray arm 14 while flow to the upper spray arm 13 is blocked by the ball 28. Wash liquid strikes the objects in the wash chamber 15 and flows down through the coarse filter 16, through the fine filter 17, and into the sump 12 as described above. Additionally, the clean off spray nozzle 21 of the lower spray arm 14 clears the fine filter 17 as described above.

After about 90 seconds, the auxiliary cam 82 opens the wash interval switch 50 to deenergize the pump motor 24 and pump 22 for about 0.75 seconds. The pause in operation of the pump 22 causes the ball 28 to change positions. The motor interval switch 50 closes again and wash liquid flows through the valve 27 and the conduit 25 to the upper spray arm 13. Wash liquid strikes the objects in the wash chamber 15 and flows down through the coarse filter 16, through the fine filter 17, and into the sump 12 as described above. Because the lower spray arm 14 is not operating, however, the clean off spray nozzle 21 of the lower spray arm 14 does not clear the fine filter 17.

Operation of the pump 22 continues for about 90 seconds until the cam disk 55 opens the motor interval switch 50 for about 3 seconds. The pause in operation of the pump 22 again causes the ball 28 switch positions. The motor interval switch 50 closes again and wash liquid flows through the valve 27 and the conduit 26 to the lower spray arm 14. Operation continues with alternating flow to the spray arms 13, 14 until the predetermined "on-time" for the pump 22 during the particular cycle is completed. The cam disk 55 opens the motor interval switch 50 and the remainder of the dishwasher cycle is completed.

Although particular embodiments of the invention have been described in detail, it is understood that the invention is not limited correspondingly in scope, but includes all changes and modifications coming within the spirit and terms of the claims appended herto.

What is claimed is:

1. A method of washing objects in a dishwasher having upper and lower spray arms, said method comprising the steps of:

continuously spraying wash liquid from the lower spray arm during initial cycles; and alternately spraying wash liquid from the lower spray arm and the upper spray arm during a wash cycle, said wash cycle occurring after said initial cycles.

2. The method according to claim 1, wherein said initial cycles include a pre-wash cycle.

3. The method according to claim 1, wherein said step of alternately spraying wash liquid includes the steps of energizing and deenergizing a pump to interrupt flow of wash liquid to a valve, said valve adapted to change flow of wash liquid to one of the upper and lower spray arms to the other of the upper and lower spray arms in response to interruptions in flow.

4. The method according to claim 3, wherein said step of deenergizing the pump includes deenergizing the pump for a period of about 0.75 seconds.

5. The method according to claim 3, wherein said step of deenergizing the pump includes deenergizing the pump for a period of about 3 seconds.

6. The method according to claim 1, further comprising the steps of filtering wash liquid entering a sump with a filter and spraying wash liquid from a spray nozzle of the lower spray arm directly onto the filter to prevent the filter from clogging.

7. A method of washing objects in a dishwasher having upper and lower spray arms, said method comprising the steps of:

continuously spraying wash liquid from the lower spray arm during at least a portion of a pre-wash cycle; and alternately spraying wash liquid from the lower spray arm and the upper spray arm during a wash cycles, the wash cycle occurring after the pre-wash cycle.

8. The method according to claim 7, further comprising the step of continuously spraying wash liquid from the lower spray arm during at least one pre-rinse cycle, the pre-rinse cycle occurring after the pre-wash cycle and before the wash cycle.

9. The method according to claim 7, further comprising the step of alternately spraying wash liquid from the lower spray arm and the upper spray arm during at least one rinse cycle, the rinse cycle occurring after said wash cycle.

10. The method according to claim 7, wherein said step of alternately spraying wash liquid includes the steps of energizing and deenergizing a pump to interrupt flow of wash liquid to a valve, said valve adapted to change flow of wash liquid to one of the upper and lower spray arms to the other of the upper and lower spray arms in response to interruptions in flow.

11. The method according to claim 10, wherein said step of deenergizing the pump includes deenergizing the pump for a period of about 0.75 seconds.

12. The method according to claim 10, wherein said step of deenergizing the pump includes deenergizing the pump for a period of about 3 seconds.

13. The method according to claim 7, further comprising the steps of filtering wash liquid entering a sump with a filter and spraying wash liquid from a spray nozzle of the lower spray arm directly onto the filter to prevent the filter from clogging.

14. A method of washing objects in a dishwasher having upper and lower spray arms within a wash chamber, said method comprising the steps of:

continuously spraying wash liquid from the lower spray arm during a pre-wash cycle and at least one pre-rinse cycle, said pre-rinse cycle occurring after the pre-wash cycle;

alternately spraying wash liquid from the lower spray arm and the upper spray arm during a wash cycle and at least one rinse cycle, said wash cycle occurring after said pre-rinse cycle and before said rinse cycle;

filtering wash liquid entering a sump from the wash chamber with a filter; and directly spraying wash liquid onto the filter to prevent the filter from clogging when the lower spray arm is spraying wash liquid.

15. The method according to claim 14, wherein said step of alternately spraying wash liquid includes the steps of energizing and deenergizing a pump to interrupt flow of wash liquid to a valve, said valve adapted to change flow of wash liquid to one of the upper and lower spray arms to the other of the upper and lower spray arms in response to interruptions in flow.

16. The method according to claim 1, further comprising the step of stopping spray from said the lower spray arm for a period of time after the initial cycles and before the wash cycle.

17. The method according to claim 7, further comprising the step of stopping spray from said the lower spray arm for a period of time after the pre-wash cycle and before the wash cycle.

18. The method according to claim 14 further comprising the step of stopping spray from said the lower spray arm for a period of time after the pre-wash cycle and the pre-rinse cycle and before the wash cycle.

* * * * *

UNITED STATES PATENT AND TRADEMARK OFFICE

CERTIFICATE OF CORRECTION

PATENT NO. : 5,849,101
DATED : December 15, 1998
INVENTOR(S) : James M. Edwards et al.

It is certified that error appears in the above-identified patent and that said Letters Patent is hereby corrected as shown below:

Title page,
Item [21], Appl. No., please delete "692,438" and insert therefor -- 08/692,438 --.

Signed and Sealed this

Seventeenth Day of August, 2004

JON W. DUDAS
*Acting Director of the United States Patent and Trademark Office*